US010125596B2

(12) United States Patent
Waid et al.

(10) Patent No.: US 10,125,596 B2
(45) Date of Patent: Nov. 13, 2018

(54) METHODS, APPARATUS AND PRODUCTS FOR PRODUCTION OF FLUIDS FROM SUBTERRANEAN FORMATIONS

(71) Applicants: Margaret Cowsar Waid, Houston, TX (US); Charles Carter Waid, Houston, TX (US)

(72) Inventors: Margaret Cowsar Waid, Houston, TX (US); Charles Carter Waid, Houston, TX (US)

( * ) Notice: Subject to any disclaimer, the term of this patent is extended or adjusted under 35 U.S.C. 154(b) by 387 days.

(21) Appl. No.: 14/331,125

(22) Filed: Jul. 14, 2014

(65) Prior Publication Data

US 2016/0130927 A1 May 12, 2016

Related U.S. Application Data

(60) Provisional application No. 61/987,374, filed on May 1, 2014, provisional application No. 62/010,346, filed on Jun. 10, 2014.

(51) Int. Cl.
*E21B 43/14* (2006.01)
*E21B 43/38* (2006.01)
(Continued)

(52) U.S. Cl.
CPC ..... *E21B 43/38* (2013.01); *E21B 17/18* (2013.01); *E21B 43/114* (2013.01);
(Continued)

(58) Field of Classification Search
CPC ..... E21B 43/00; E21B 43/02; E21B 43/12; E21B 43/14; E21B 43/013; E21B 17/18; E21B 49/088; E21B 49/084; E21B 43/038
See application file for complete search history.

(56) References Cited

U.S. PATENT DOCUMENTS 6,301,959 B1 * 10/2001 Hrametz ..... E21B 33/1243 166/250.17
8,113,293 B2 * 2/2012 Corre ..... E21B 33/1243 166/145
(Continued)

*Primary Examiner* — William D Hutton, Jr.
*Assistant Examiner* — Steven A MacDonald
(74) *Attorney, Agent, or Firm* — Gilbreth & Associates, PC; J.M. (Mark) Gilbreth

(57) ABSTRACT

Methods, apparatus and products for separating oil and mud filtrate down hole and production of each to the surface via separate tubing, that includes custom engineered drill pipe for which two types of openings called ports have been cut or drilled: production ports and isolation ports. The production port produces formation fluid (normally hydrocarbons) from a perforation. In one non-limiting embodiment, a tube is welded to the inside of the casing at each production port to transmit the formation fluid to the top of the drill pipe section where it is attached to a custom engineered casing collar (described below) designed to allow flow to the next drill pipe section of the device. The isolation port produces mud filtrate from the adjacent borehole wall exterior to the casing, and these isolation ports are arranged in a pattern around each production port to keep mud filtrate in the invaded zone from reaching the production port. The number and placement of the production ports as well as the number, placement and shape of the isolation ports are determined using the information regarding the perforating design and other information such as the filtrate type and estimates of invasion depth as determined by well logs. Packers are set above and below the apparatus to provide an "isolation" chamber to contain the produced filtrate. Tubing through the upper packer will produce the filtrate to the surface via differential pressure or pumping. After the casing has been cemented, the perforating guns in the production ports are fired to begin production of formation fluid.

6 Claims, 2 Drawing Sheets

(51) Int. Cl.

| | |
|---|---|
| ***E21B 17/18*** | (2006.01) |
| ***E21B 43/12*** | (2006.01) |
| ***E21B 47/06*** | (2012.01) |
| ***E21B 43/114*** | (2006.01) |
| ***E21B 49/08*** | (2006.01) |

(52) U.S. Cl.
CPC ..... *E21B 43/121* (2013.01); *E21B 47/06* (2013.01); *E21B 49/087* (2013.01); *E21B 49/088* (2013.01)

(56) References Cited

U.S. PATENT DOCUMENTS

| | | | | |
|---|---|---|---|---|
| 2009/0308604 | A1* | 12/2009 | Corre | E21B 33/1243 166/250.17 |
| 2010/0122822 | A1* | 5/2010 | Corre | E21B 49/08 166/387 |
| 2014/0224511 | A1* | 8/2014 | Pessin | E21B 33/1275 166/387 |

* cited by examiner

METHODS, APPARATUS AND PRODUCTS FOR PRODUCTION OF FLUIDS FROM SUBTERRANEAN FORMATIONS

RELATED APPLICATION DATA

This patent application claims priority from U.S. Provisional Patent Application Ser. No. 61/987,374 filed May 1, 2014 and from U.S. Patent Application Ser. No. 62/010,346 filed Jun. 10, 2014, the applications of which are herein incorporated by reference.

BACKGROUND OF THE INVENTION

1. Field of the Invention

The present invention relates to the extraction of fluids from subterranean formations. In another aspect, the present invention relates to the extraction of fluids from subterranean formations drilled by mud rotary drilled wells. In even another aspect, the present invention relates to the extraction of fluids from mud drilled hydrocarbon wells, water supply wells, and monitoring wells. In still another aspect, the present invention relates to the extraction of a target fluid and mud filtrate down hole and with each of the target fluid and the mud filtrate being produced to the surface via separate tubing. In yet another aspect, the present invention relates to the production of hydrocarbons and mud filtrate down hole and with each of the hydrocarbons and the mud filtrate being produced to the surface via separate tubing. In even still another aspect, the present invention relates to the production of water and mud filtrate down hole and with each of the water and the mud filtrate being produced to the surface via separate tubing. In even yet another aspect, the present invention relates to the extraction of a test sample and mud filtrate down hole and with each of the test sample and the mud filtrate being extracted via separate tubing. It is possible that only one of the hydrocarbon or the mud filtrate may require a production tubing, with the cased wellbore itself being one of the tubings. It is also possible that the mud filtrate may be re-injected downhole into a separate zone of lower pressure that has been depleted or does not contain hydrocarbons or to raise the pressure of another hydrocarbon or water producing zone for enhanced or improved oil recovery.

2. Description of the Related Art

Rotary drilling utilizing a circulating drilling mud is commonly used for drilling wells into the subterranean, non-limiting examples of which include hydrocarbon wells, water wells, and monitoring wells. Basically, rotating hollow drill pipes carry down bentonite and barite infused drilling muds to lubricate, cool, and clean the drilling bit, control downhole pressures, stabilize the wall of the borehole and remove drill cuttings. The drilling mud travels back to the surface around the outside of the drill pipe, called the annulus.

During such drilling mud rotary drilling, in which the well-bore pressure is maintained at a pressure higher than formation pressure, mud filtrate invades porous, permeable formations and the solids in the mud form a mudcake on the borehole wall. In the production of hydrocarbons, "invasion" is generally thought of as mud filtrate simply displacing formation water and any hydrocarbons to some distance away from the borehole wall. The irregularly shaped invaded zone surrounding the borehole wall becomes saturated with mud filtrate. In the production of hydrocarbons, it is not uncommon for the produced fluids to contain some percentage of mud filtrate. This can become an expensive problem, because not only is there loss in revenue because the produced fluid contains less hydrocarbon, there are incurred expenses by the extra cost of transporting the oil/filtrate and the cost of separating the mud filtrate from the oil. Additional costs may occur because almost all mud filtrate, whether it is oil based or is water based contains significant amounts of water (as water sources are drilled through), and water together with water velocity causes corrosion in pipelines. Indeed, water may significantly fill a pipeline over time, reducing the amount of hydrocarbons which may be transported.

There is certainly a need in the art for improved production methods, apparatus and products that provide for production of the desired fluid with ideally no mud filtrate, perhaps just little mud filtrate, or at the very least reduced mud filtrate.

Invasion also affects all shallow-reading tools such as density, neutron porosity and micrologs. These logs had to be interpreted carefully, particularly when water-base filtrate was suspected of displacing oil or gas. Deep-reading resistivity logs designed to see beyond the invaded zone, a few feet from the borehole, often did not see deep enough, and these needed correction to obtain true formation resistivity.

In oil and gas exploration, drill stem testing is a procedure to isolate, stimulate and flow a downhole formation to determine the fluids present and the rate at which they can be produced. Generally, the main objective of drill stem testing is to evaluate the commercial viability of a zones economic potential by identifying productive capacity, pressure, permeability or extent of an oil or gas reservoir. These tests can be performed in both open and cased hole environments and provide exploration teams with valuable information about the nature of the reservoir. Drill stem testing involves deploying a series of tools known as a test bottomhole assembly. A basic drill stem test bottomhole assembly consists of a packer or packers, which act as an expanding plug to be used to isolate sections of the well for the testing process, valves that may be opened or closed from the surface during the test, and recorders used to document pressure during the test. In addition to packers a downhole valve is used to open and close the formation to measure reservoir characteristics such as pressure and temperature which are charted on downhole recorders within the bottomhole assembly.

The following are merely a few of the many patent publications and patents directed to formation testing.

U.S. Pat. No. 2,775,304 to Zandmer issued Dec. 25, 1956, discloses an apparatus for providing ducts between borehole wall and casing. Essentially, plungers moveably supported in bushings fixed in holes through the casing are moved outwardly to engage the wall of the well bore and provide cores surrounded by the sealing material and the bushings, thus affording communication between the wall of the bore hole and the interior of the casing.

U.S. Pat. No. 3,611,799 to Davis issued Oct. 12, 1971, discloses a multiple chamber earth formation fluid sampler for obtaining fluid samples from earth formations wherein a borehole exploring unit supported for movement through the borehole is provide with spaced means for isolating borehole wall formation portions from borehole fluids.

U.S. Pat. No. 4,716,973 to Cobern issued Jan. 5, 1988, discloses a method for evaluation of formation invasion and formation permeability by conducting a series of formation resistivity loggings in the operation of a measurement while drilling (MWD) logging system.

U.S. Pat. No. 5,829,520 to Johnson issued Nov. 3, 1998, discloses a method and apparatus for testing, completion and/or maintaining wellbores using a sensor device. The device is a data acquisition device capable of monitoring, recording wellbore and/or reservoir characteristics while capable of fluid flow control, and the method is for monitoring and/or recording at least one downhole characteristic during testing, completion and/or maintenance of a wellbore. The device includes an assembly within a casing string comprising a sensor probe having an optional flow port allowing fluid flow while sensing wellbore and/or reservoir characteristics. The device also includes a microprocessor, a transmitting device, and a controlling device located in the casing string for processing and transmitting real time data. A memory device is also provided for recording data relating to the monitored wellbore or reservoir characteristics. Examples of downhole characteristics which may be monitored include: temperature, pressure, fluid flow rate and type, formation resistivity, cross-well and acoustic seismometry, perforation depth, fluid characteristic or logging data. With the microprocessor, hydrocarbon production performance maybe enhanced by activating local operations in additional associated downhole equipment, e.g., water shut-off operations at a particular zone, maintaining desired performance of a well by controlling flow in multiple wellbores, zone mapping on a cumulative basis, flow control operations, spacing casing and its associated flow ports in multiple zone wellbores, maintaining wellbore and/or reservoir pressure, sensing perforation characteristics, sensing reservoir characteristics or any number of other operations.

U.S. Pat. No. 5,934,374 to Hrametz et al. issued Aug. 10, 1999 discloses a formation tester (the only embodiment mentioned is electric wireline, and significant downhole power is required) with improved sample collection system for collecting a formation fluid in a chamber at a predetermined pressure and for maintaining the pressure of the collected fluid at a desired level during the retrieval of the chamber to the surface. The formation fluid is pumped into the chamber while a piston exposed to the hydrostatic pressure maintains the chamber pressure at the hydrostatic pressure. During retrieval of the chamber, the pressure in the chamber is maintained at a predetermined level by pumping wellbore fluid to the piston. A control unit at the surface is utilized for controlling the operation of the formation tool.

U.S. Pat. No. 6,301,959 to Hrametz et al. issued Oct. 16, 2001, discloses a focused formation fluid sampling probe that uses two hydraulic lines to recover formation fluids from two zones in a borehole. One of the zones is a guard zone and the other is a probe zone. The guard zone and the probe zone are isolated from each other by mechanical means, with the guard zone surrounding the probe zone and shielding it from the direct access to the borehole fluids. Operation of the tool involves withdrawal of fluid from both zones. Borehole fluids are preferentially drawn into the guard zone so that the probe zone recovers the formation fluid substantially free of borehole fluids. Separation of the guard zone from the probe zone may be accomplished by means of an elastomeric guard ring, by inflatable packers or by tubing. The device can be adapted for use either on a wireline or in an early evaluation system on a drillstring.

U.S. Pat. No. 6,786,086 to Hashem issued Sep. 7, 2004, discloses a method for determining the in-situ effective mobility of hydrocarbons in a formation layer and the effective permeabilty of a formation, in which a formation test tool, having a fluid analyzer, induces sample fluid to flow from the formation, the sample being analyzed and discarded where it includes fluid from the invaded zone, so as to perform the pressure test on uncontaminated formation fluid.

OTC 18201, *Advances in Fluid Sampling With Formation Testers for Offshore Exploration*, C. Del Campo et al., Offshore Technology Conference, May 1-4, 2006, discloses that formation fluid samples provide valuable information for field development, and that drilling mud filtrate contamination reduces the sample quality drastically, and the current industry technique to obtain clean fluid samples requires a long pumping time. This can be costly, especially in deep offshore wells. Also disclosed is a new formation fluid sampling apparatus which separates filtrate contamination efficiently from the virgin reservoir fluid; the fluid sample cleans up much faster than with the conventional approach. In addition to the new sampling apparatus, downhole fluid characterization techniques, including contamination monitoring, composition measurement, and single-phase assurance, are presented. The apparatus provides real-time fluid property information, and helps ensure that representative samples are obtained.

*Wireline Sampling Technology Enables Fluid Sampling Without Contamination* JPT, September 2006, discloses a focused sampling technique using a new wireline sampling tool that was applied successfully in the Cairn Energy-operated Bhagyam field, Rajasthan, northwest India. Favorable results were achieved in this field, formation characteristics of which-highly viscous, waxy crude and oil-based mud (OBM)-had presented numerous challenges in obtaining good representative reservoir-mud samples, even after long pumping times. Of the 18 samples collected from two wells, 83% were of pressure/volume/temperature (PVT) quality, and 33% of the samples showed zero mud-filtrate contamination. The sampling technique separates drilling-mud-filtrate contamination efficiently from the formation fluid in the early stage of the sampling process, allowing cleaner samples and faster collection compared to traditional probe-type wireline formation testers.

*Wireline and While-Drilling Formation-Tester Sampling with Oval, Focused, and Conventional Probe Types in the Presence of Water- and Oil-Base Mud-Filtrate Invasion in Deviated Wells*, Abdolhamid Hadibeik et al., Society of Petrophysicists and Well Log Analysts $50^{th}$ Annual Logging Symposium, Jun. 21-24, 2009, quantifies the viability of sampling in the drilling environment by way of numerical simulations, and considers the dynamic nature of invasion while drilling when using both new and conventional probe configurations to retrieve fluid samples. The prior art assumed a time-constant rate of invasion that was close to that of the final stages of invasion. Furthermore, most simulations of wire line formation-tester measurements assumed that invasion ended at the time when fluid pumpout began. Both of these assumptions are optimistic for a drilling tool. To more realistically simulate the invasion during drilling, a mudcake model is used that continues to grow in thickness and sealing effectiveness during invasion and throughout the sampling process. With this mudcake model there are higher rates of invasion soon after drilling. Simulation results focus on scenarios in which water-base mud (WBM) and oil-base mud (OBM) invade an oil-bearing zone. This paper also studies the accuracy of functions used to estimate contamination in an OBM environment. The base model consists of a typical probe-type tool in a vertical well wherein fluid samples are retrieved using a time-constant flow rate. Invasion time is varied from 1 to 48 hours to compare drilling and wireline sampling tools. This paper quantifies mudcake sealing effectiveness, as well as the effect of borehole deviation. Oval (elongated) and focusing guard-style probes are compared to standard probe configurations in various petrophysical rock types. Simulations of fluid cleanup times for a variety of rock types and wellbore deviation angles indicate that the oval focused probe retrieves the cleanest fluid sample in the least amount of time.

*Improved Techniques for Acquiring Pressure and Fluid Data in a Challenging Offshore Carbonate Environment*, K. D. Contreiras et al., Search and Discovery Article No. 40433, posted Aug. 10, 2009, discloses that the combination of low permeability, oil base mud and near saturated oils presents one of the most challenging environments for fluid sampling with formation testers. Low permeability indicates that the drawdown while sampling will be high but this is contra-indicated for oils that are close to saturation pressure. Prior art solutions suggest reducing the flow rate but in wells drilled with OBM an unacceptably long clean-up time would result.

The Pinda formation in Block 2 offshore Angola presents just such a challenge. Formation mobilities are in the low double or single ¬digits, saturation pressure is usually within a few hundred psi of formation pressure and borehole stability indicates that the wells must be drilled with oil base mud. Further disclosed is a two-step solution was used, that first includes a high efficiency pretest-only WFT in order to quickly gather formation pressure data and mobility data. This data is then used to design the sampling string which is a combination of an inflatable dual packer with focused probe. Further disclosed is the decision process that governs the choice of pump, displacement unit, probe and packer. Particular attention is paid to the unique pump configurations that are required to effectively manage the drawdowns when using the probe and also to allow sufficient flow rate when using a dual packer.

*Comparison of Wire line Formation-Tester Sampling with Focused and Conventional Probes in the Presence of Oil-Base Mud-Filtrate Invasion*, Mayank Malik et al., Petrophysics, Vol. 50, No. 5, October 2009, discloses that in the course of fluid sampling, varying concentrations of oil base mud (OBM) will lead to variations of fluid properties such as viscosity, density, and gas-oil ratio (GOR). A focused probe can be useful in reducing OBM contamination by diverting flow into different channels without compromising fluid pumpout time. However, it is important to properly quantify the relative performance of focused and conventional probes for a wide range of field conditions. Further disclosed is the performance of different probes under the same simulated field conditions and for a comprehensive set of petrophysical and fluid properties. Results indicate that sample quality generally improves when the flow is split between the guard and sample probes, but the specific amount of improvement depends on probe geometry, fluid composition, and formation properties. Permeability anisotropy, presence of a flow boundary, and lack of mud-filtrate invasion can help to improve sample quality. In addition, fluid cleanup can be accelerated by altering both the probe design and the flow-rate ratio between the sample and guard fluid streams, thereby leading to increased pressure differential between the sample and guard areas and enhancing the "coning" of the mud-filtrate invasion front.

*History Matching of Multiphase-Flow Formation-Tester Measurements Acquired with Focused-Sampling Probes in Deviated Wells*, Renzo Angeles et al., Petrophysics, February 2011, discloses that complex tool and rock-formation properties are becoming prevalent in formation-testing operations. As hydrocarbon exploration shifts toward high-cost and high-risk frontiers, it is now common to measure pressures and to acquire fluid samples in deviated and sidetrack wellbores. At the same time, standard analytical and numerical methods used for the interpretation of formation-tester measurements continue to be based on restricting physical assumptions such as single-phase flow, over-simplistic mud-filtrate invasion radial profiles, and vertical wellbores. Interpretation of transient focused-sampling measurements acquired in wells drilled with oil-based mud (OBM) is particularly challenging. The combination of miscibility (between mud-filtrate and in-situ oil) and non-standard probe geometry requires more petrophysically reliable interpretation methods than currently available with single-phase analytical techniques. Further disclosed is the application of a three-dimensional (3D) multiphase-flow method to interpret two field data sets acquired with focused-sampling probes in deviated wells. The interpretation method includes the dynamic effects of OBM mud-filtrate invasion and their corresponding impact on fluid properties, such as viscosity and density, in the near-wellbore region. Numerical simulations verify the consistency of the measurements and quantify the role played by petrophysical, fluid, and geometrical properties on the time evolution of the measurements. Adjustments are made to key petrophysical properties involved in the simulations to reproduce transient measurements of pressure and GOR acquired with a commercial focused fluid-sampling probe. In addition, resistivity logs are numerically simulated to infer the spatial distribution of fluids in the near-borehole region prior to the onset of fluid sampling. Sensitivity studies further appraise the uncertainty of permeability estimates due to wellbore deviation, OBM filtrate viscosity, and radius of invasion. Further disclosed is that irreducible water saturation was influential to determining the spatial distribution of fluids around the well bore as it affected both the separation of apparent resistivity curves and the early-time portion of pressure transient measurements; simulation results also indicate that the angle of wellbore deviation can bias permeability estimates especially for cases of high-permeability formations as well as for the case of large viscosity contrasts of the fluids involved during invasion; and that numerical simulation and history matching of formation-tester measurements acquired under complex environmental conditions is a reliable procedure to diagnose noise, biases, and inconsistencies in transient measurements otherwise undetectable with standard interpretation methods.

U.S. Pat. No. 8,109,140 to Tustin, et al., issued Feb. 7, 2012, discloses a reservoir sampling apparatus that is described as having at least one probe adapted to provide a fluid flow path between a formation and the inner of the apparatus with the flow path being sealed from direct flow of fluids from the borehole annulus with a heating projector adapted to project heat into the formation surrounding the probe and a controller to maintain the temperature in the formation below a threshold value.

U.S. Pat. No. 8,297,364 to Agrawal, et al., issued Oct. 30, 2012, discloses a telescopic unit with dissolvable barrier wherein the telescopic member includes, at least a central component and a barrier disposed within the central component, the barrier has a selectively tailorable dissolution rate curve and has structural properties enabling the containment of high pressure prior to structural failure of the barrier through dissolution.

SPE 162345, *Simulation Modeling for Optimized LWD Fluid Sampling Under Different Invasion Profiles* by Samarth Agrawal et al, Society of Petroleum Engineers, Abu Dhabi International Petroleum Exhibition & Conference, Nov. 11-14, 2012, discusses the effects of dynamic invasion processes on Logging While Drilling (LWD) fluid sampling and compares its performance with Wire Line (WL) based fluid sampling. The results of the simulation study performed revealed that when the wait time after the drilling is optimized, LWD can provide cleaner samples in shorter cleanup time than WL sampling. It also revealed that the reservoir fluid breakthrough time would be shorter in LWD sampling compared to that of WL. It also discloses that with proper modeling, an optimized sampling program can be executed to meet the objectives of the LWD sampling operations in the most economic manner.

In spite of the advances in the prior art, there is still a need in the art for methods, apparatus and products for overcoming invasion and extracting a target fluid from the subterranean separate from extracting mud filtrate.

There is another need in the art for methods, apparatus and products for overcoming invasion and extracting a target fluid from the subterranean that is free of, relatively free of, or has a lesser amount of mud filtrate.

There is even another need in the art for methods, apparatus and products for overcoming invasion and producing a target fluid and mud filtrate through separate channels.

There is still another need in the art for methods, apparatus and products for overcoming invasion and producing hydrocarbons and mud filtrate through separate tubing/piping to the surface.

There is yet another need in the art for methods, apparatus and products for formation sampling, testing, and/or analysis that extracts formation fluid in a manner that is free or relatively free of the mud filtrate.

These and other needs in the art will become apparent to those of skill in the art upon review of this specification, including its drawings and claims.

SUMMARY OF THE INVENTION

It is an object of the present invention to provide for methods, apparatus and products for overcoming invasion and extracting a target fluid from the subterranean separate from extracting mud filtrate.

It is another object of the present invention to provide for methods, apparatus and products for overcoming invasion and extracting a target fluid from the subterranean that is free of, relatively free of, or has a lesser amount of mud filtrate.

It is even another object of the present invention to provide for methods, apparatus and products for overcoming invasion and producing a target fluid and mud filtrate through separate channels.

It is still another object of the present invention to provide for methods, apparatus and products for overcoming invasion and producing hydrocarbons and mud filtrate through separate tubing/piping to the surface.

It is yet another object of the present invention to provide for methods, apparatus and products for formation sampling, testing, and/or analysis that extracts formation fluid for sampling in a manner that is free or relatively free of the mud filtrate.

These and other objects of the present invention will become apparent to those of skill in the art upon review of this specification, including its drawings and claims.

According to various embodiments of the present invention, there are provided methods, apparatus and products for production of fluids from subterranean formations.

According to one embodiment of the present invention, there is provided, a production system for producing a desired formation fluid from a producing zone in a formation below a terranean surface, the formation surrounding a cased wellbore having a drilling fluid. The system may include a production member in fluid communication with the producing zone to allow the desired formation fluid to flow into the production member, the production member having a first controlled pressure. The system may also include an isolation member, said isolation member defining an isolation zone adjacent the producing zone said isolation member being maintained at a second controlled pressure, the first and second pressures being varied such that flow of the drilling fluid into the producing zone is impeded. The system may also include a flow path defined from the production member to the surface for allowing the desired formation fluid to flow through the casing and to the surface.

According to another embodiment of the present invention, there is provided a method for producing a desired formation fluid from a producing zone in a formation below a terranean surface, the formation surrounding a cased wellbore having a drilling fluid. The method may include (a) placing a production member into the cased wellbore in fluid communication with the producing zone to allow the desired formation fluid to flow into the production member, the production member having a first controlled pressure; (b) placing an isolation member into the cased wellbore, said isolation member defining an isolation zone adjacent the producing zone said isolation member being maintained at a second controlled pressure; (c) creating a flow path defined from the production member to the surface for allowing the desired formation fluid to flow to the surface; (d) controlling the pressures of the production member and isolation member such that the isolation member pressure is the same as or lower than the production member pressure such that flow of the drilling fluid into the producing zone is impeded; and/or (e) flowing formation fluid from the production zone to the surface through the flow path.

According to even another embodiment of the present invention, there is provided a method for producing a desired formation fluid from a producing zone in a formation below a terranean surface, the formation surrounding a cased wellbore having a drilling fluid, the method may include (a) placing a production member into the cased wellbore in fluid communication with the producing zone to allow the desired formation fluid to flow into the production member, the production member having a first controlled pressure; (b) placing an isolation member into the cased wellbore, said isolation member defining an isolation zone adjacent the producing zone said isolation member being maintained at a second controlled pressure; (c) creating a flow path defined from the production member to the surface for allowing the desired formation fluid to flow to the surface; (d) controlling the pressures of the production member and isolation member such that the isolation member pressure is the same as or lower than the production member pressure such that flow of the drilling fluid into the producing zone is impeded; (e) flowing formation fluid from the production zone to the surface through the flow path; (f) connecting a isolation flow line to the isolation member; (g) connecting a production flow line to the production member; and/or (h) lowering the pressure in the isolation flow line to below the pressure of the production flow line.

According to still another embodiment of the present invention, there is a production system for producing a desired formation fluid from a producing zone in a formation below a terranean surface, the formation surrounding a cased wellbore having a drilling fluid, the system may comprise (a) a production member in fluid communication with the producing zone to allow the desired formation fluid to flow into the production member, the production member having a first controlled pressure; (b) an isolation member, said isolation member defining an isolation zone adjacent the producing zone said isolation member being maintained at a second controlled pressure, the first and second pressures being varied such that flow of the drilling fluid into the producing zone is impeded; (c) a production flow line associated with the production member, defining a formation fluid flow path from the producing zone through the casing to the surface; (d) an isolation flow line associated with the isolation member; (e) a production pump adapted to control pressure in the production flow line and pump formation fluid to the surface; and/or (f) an isolation pump adapted to control pressure in the isolation flow line.

According to yet another embodiment of the present invention, there is provided a production system for producing a desired formation fluid from a producing zone in a formation below a terranean surface, the formation surrounding a cased wellbore having a drilling fluid. The system may include (a) a production member in fluid communication with the producing zone to allow the desired formation fluid to flow into the production member, the production member having a first controlled pressure; (b) an isolation member, said isolation member defining an isolation zone adjacent the producing zone said isolation member being maintained at a second controlled pressure, the first and second pressures being varied such that flow of the drilling fluid into the producing zone is impeded; (c) a production flow line associated with the production member, defining a formation fluid flow path from the producing zone through the casing to the surface; (d) an isolation flow line associated with the isolation member; and/or (e) a first control device for controlling fluid flow into the production flow line and a second control device for controlling fluid flow into the isolation flow line, wherein the first control device maintains a first pressure in the production flow line and the second control device maintains a second pressure in the isolation flow line, the first pressure being greater than or equal to the second pressure.

According to even still another embodiment of the present invention, there is provided a production system for producing a desired formation fluid from a producing zone in a formation below a terranean surface, the formation surrounding a cased wellbore having a drilling fluid. The system may include: (a) a production member in fluid communication with the producing zone to allow the desired formation fluid to flow into the production member, the production member having a first controlled pressure; (b) an isolation member, said isolation member defining an isolation zone adjacent the producing zone said isolation member being maintained at a second controlled pressure, the first and second pressures being varied such that flow of the drilling fluid into the producing zone is impeded; (c) a production flow line associated with the production member, defining a formation fluid flow path from the producing zone through the casing to the surface; (d) an isolation flow line associated with the isolation member; (e) a fluid retrieving device in fluid communication with the isolation zone removing fluid from the isolation zone in order to reduce the flow of the drilling fluid into the production zone; (f) a first control device for controlling fluid flow into the production flow line; and/or (g) a second control device for controlling fluid flow into the isolation flow line. Wherein the first control device maintains a first pressure in the production flow line and the second control device maintains a second pressure in the isolation flow line, the first pressure being greater than or equal to the second pressure.

According to even yet another embodiment of the present invention, there is provided a production system for producing a desired formation fluid from a producing zone in a formation below a terranean surface, the formation surrounding a cased wellbore having a drilling fluid. The system may include: (a) a tank positioned on the surface adapted to receive the desired formation fluid; (b) a production member in fluid communication with the producing zone to allow the desired formation fluid to flow into the production member, the production member having a first controlled pressure; (c) an isolation member, said isolation member defining an isolation zone adjacent the producing zone said isolation member being maintained at a second controlled pressure, the first and second pressures being varied such that flow of the drilling fluid into the producing zone is impeded; (d) a production flow line associated with the production member, defining a formation fluid flow path from the producing zone through the casing to the tank on the surface; and/or (e) an isolation flow line associated with the isolation member.

According to yet even another embodiment of the present invention, there is provided a production system for producing a desired formation fluid from a producing zone in a formation below a terranean surface, the formation surrounding a cased wellbore having a drilling fluid. The system comprises: (a) a production member in fluid communication with the producing zone to allow the desired formation fluid to flow into the production member, the production member having a first controlled pressure; (b) an isolation member, said isolation member defining an isolation zone adjacent the producing zone said isolation member being maintained at a second controlled pressure, the first and second pressures being varied such that flow of the drilling fluid into the producing zone is impeded; and/or (c) a fluid retrieving device in fluid communication with the isolation zone removing fluid from the isolation zone in order to reduce the flow of the drilling fluid into the production zone. These and other embodiments of the present invention will become apparent to those of skill in the art upon review of this specification, including its drawings and claims.

DETAILED DESCRIPTION OF THE INVENTION

Figure 1:
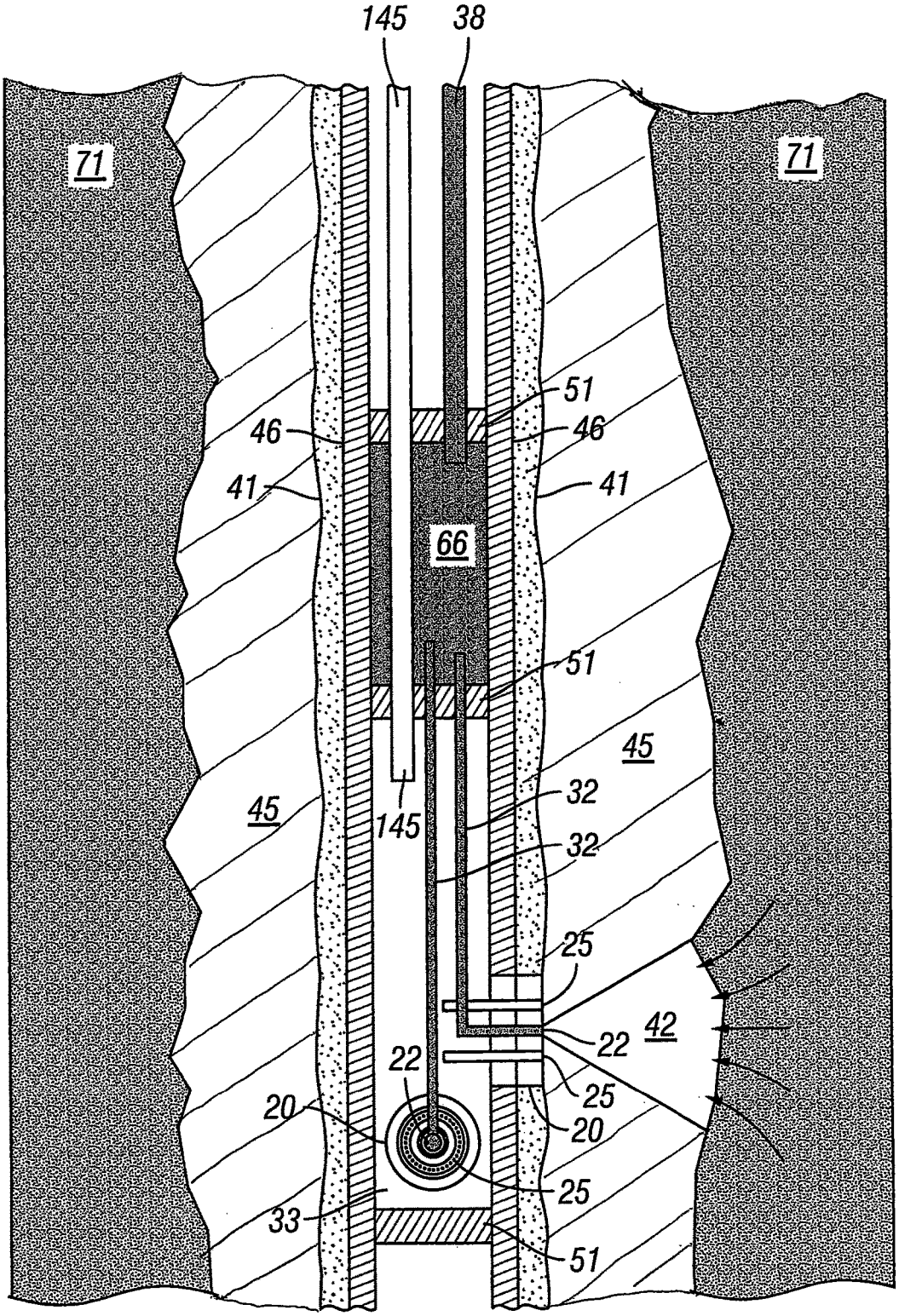
FIG. 1 is a schematic of one non-limiting embodiment of the present invention, showing production port 22 producing the desired formation fluid 42 (normally from production port 22 to the surface via path 32, generally tubing, piping, conduit, etc.).

The production of hydrocarbons is many times complicated by the presence of mud filtrate in the production fluids.

By way of non-limiting example, it is not unusual to find that 10-20% of production fluid is actually mud-filtrate.

In certain non-limiting embodiments, "mud filtrate" can be invaded fluids from the drilling or completion operations. The drilling mud may be water based or oil based. But even oil based mud usually has water in it that enters when a water zone is drilled through. The amount may be as much as 40% water or more. Thus, the produced mud filtrate will almost undoubtedly contain water which causes many problems for pipelines/facilities such as corrosion, blockage, and just filling up the pipeline so that the hydrocarbons throughput is reduced over time as water is produced. Produced water also flows downward in a slanted cased well and fills up the well so that less hydrocarbon can be produced. This produced water also makes it almost impossible to discover water leaking into casing through cracked casing or bad cement behind casing. So keeping produced water out of the cased wellbore can greatly improve production logging location of water and intervention methods for controlling unwanted water production. Most production logging tools (90 percent) are run to determine the location of unwanted water entry into a well.

The present invention provides for the gathering of formation fluid through one stream and the gathering of mud-filtrate through another stream. This gathered fluid can be utilized downhole, or can be transmitted to the surface.

According to one non-limiting embodiment of the present invention there is provided a production ports and isolation ports. Quite simply, these various port are utilized for gathering formation fluid and mud filtrate down hole and production of each to the surface via separate fluid flow paths. By maintaining the pressure in the isolation ports at or slightly below the pressure in the production ports, most of the fluid drawn into the production ports will be relatively pure formation fluid absent or mostly absent the mud filtrate. The same result is also obtained by using inflatable packer elements to create an isolation zone above and below the producing section.

The pressure in the isolation ports and the production ports is generally maintained utilized one or more pumps. In some non-limiting embodiments for example a single pump can control all of the isolation ports in a particular producing compartment (of a certain pressure); and another single pump can control all of the production ports in a particular producing compartment (of a certain pressure). Another pair of pumps may be used to control production in another producing compartment and additional pumps and packers may be used for completion and production of multiple compartments. One or more information handling systems, a non-limiting example of which includes a computer, (conveniently positioned at the surface, downhole, remote from the wellsite, or any other desirable location) can control all of them.

Referring now to FIG. 1, there is shown a schematic of one non-limiting embodiment of the present invention positioned within a cased subterranean well 14. In the present invention, the assembly 20 has a production port 22 that produces formation fluid 42 (in a path that normally comprises production port 22 to the surface 12 via path 32 to 33, that is generally tubing, piping, or conduit, etc.) from producing zone 43 coming from subterranean formation 71. The FIG. 1 schematic shows both a side view and face on view of assembly 20 as positioned in circular casing 46. The idea is to produce formation fluids from a well in commercial volumes measured in barrels per day of production for the well over the course of a long period of time as described above, rather than just take milliliter sample(s) of the formation fluid over a short period of time. Various non-limiting embodiments of the present invention will produce 1, 2, 3, 4, 5, 10, 20, 100, 1000 or more barrels of desired well fluids per day.

In some non-limiting embodiments, a producing well will comprise at least 2, 3, 4, 5, 6, 7, 8, 9, 10, 15, 20, 25, 30 or more production ports in various locations with at least a portion of those ports simultaneously in fluid communication with the producing zone, and/or are simultaneously producing the desired formation fluid. In even other non-limiting embodiments, these ports may be positioned in 2 or more producing zones, with at least a portion of these production ports all simultaneously in fluid communication with their respective production zones, and/or all simultaneously producing formation fluid from their respective production zones. In even other non-limiting embodiments, these ports may be positioned in production zone(s) at 2 or more depths in the well, with at least a portion of these production ports all simultaneously in fluid communication with their respective production zones, and/or all simultaneously producing formation fluid from their respective production zones. Certainly, the corresponding isolation ports are simultaneously operating along with the production ports.

The isolation port 25 produces mud filtrate 45 from the adjacent borehole wall 41 exterior to casing 46. The present invention generally finds most utility with cased wells, although certainly it may be utilized in uncased wells. There is at least one isolation port 25 for each production port 22, and more likely a number of isolation ports 25 arranged in some manner around each production port 22. By maintaining the pressure in the isolation ports at or slightly below the pressure in the production ports, these isolation ports 25 will create an isolation zone and intercept mud filtrate 45 in the invaded zone 47 from reaching the production port 22. The number and placement of the production ports 22 as well as the number, placement and shape of the isolation ports 25 are determined using the information regarding the perforating design and other information such as the filtrate type and estimates of invasion depth as determined by well logs.

The production ports are in fluid communication with a fluid flow path to the surface terminating in a production storage tank, or a pipeline system. Generally, fluids produced through the production ports "flow" to the surface via a fluid flow path (by pumping or formation pressure) such as a pipe, tubing or other such conduit, as opposed to being gathered in a container, with that container then taken to the surface where the gathered fluids are emptied or dumped out. In some non-limiting embodiments, there may be some downhole gathering or accumulation of fluids produced through the production ports, but after such gathering or accumulation, those fluids then are pumped or otherwise forced to the surface via formation pressure through a fluid flow path, again such as a pipe, tubing, or other such conduit. In non-limiting embodiments, production through the production ports to the surface is by pumping the desired formation fluids to the surface through a fluid path, or the desired formation fluids are forced to the surface through a fluid path using formation pressure, or a combination of pumping and formation pressure. In some non-limiting embodiments, the production tubing can be independent conventional production tubing or it can be coiled tubing, or the production tubing can also be permanently manufactured into the casing.

In the methods of the present invention, production through the production ports may be carried out for long periods of time, for example, 10 or more days, 20 or more days, 1, 2, 3, 6, 9 or more months, or 1, 2, 3, 4, 5 or more years. Once the production and isolation ports are in place, the configuration is relatively permanent and the production lasts as long as the well produces, which is measured in years.

Figure 2A:
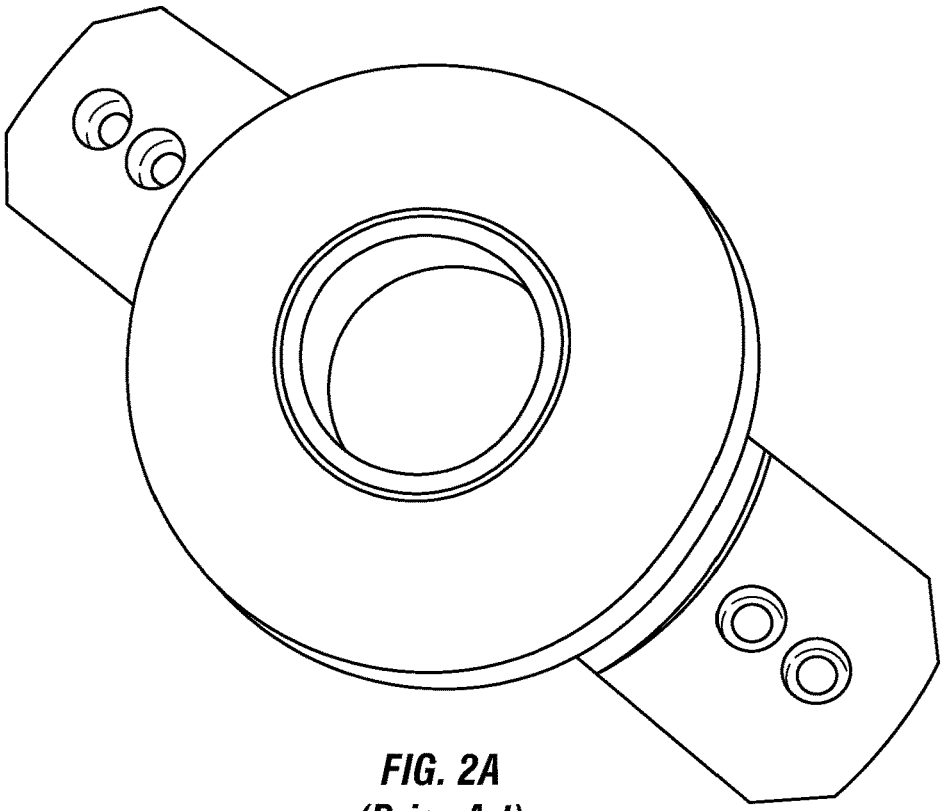
FIG. 2A (Prior Art)
FIG. 2A shows a prior art version of a rubber pad assembly.
Figure 2B:
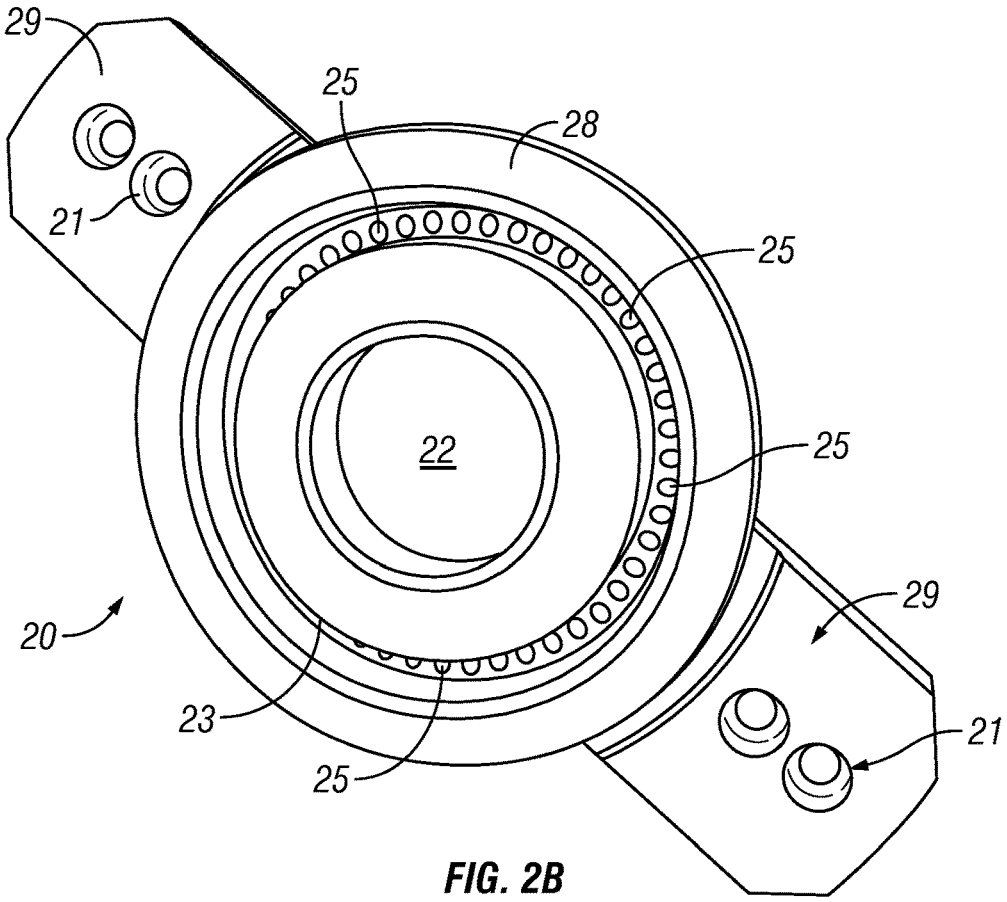
FIG. 2B shows a non-limiting embodiment of rubber pad assembly 20 defining both a production port 22 and a plurality of isolation ports 25, with rubber pad assembly including an inner rubber pad 23 and an outer rubber pad 28, with outer rubber pad 28 allowing for a tight fit into a perforation, with support member 29 extending on two sides of rubber pad assembly 20 with fastener holes 21, to allow for screws, bolts, or other fasteners to be received into holes 21 and thus secure rubber pad assembly 20 in place. The material does not have to be rubber; for example other non-limiting embodiments anticipate that it can be a metal or other composite material pad or coated metal or other composite material pad.

Referring additionally to FIG. 2, there is shown a non-limiting embodiment of rubber pad assembly 20 defining both a production port 22 and a plurality of isolation ports 25. Please understand that this is merely one non-limiting design for the assembly, which may have be of any suitable shape and configuration, and may have any suitable number, size and shape of ports 22 and 25. As shown the rubber pad assembly includes an inner rubber pad 23 and an outer rubber pad 28. It is outer rubber pad 28 that will allow for a tight fit into a perforation. Support member 29 extending on two sides of rubber pad assembly 20 with fastener holes 21, allow for screws, bolts, or other fasteners to be received into holes 21 and thus secure rubber pad assembly 20 in place. In the most simplest of embodiments, a tubular production port 22 is positioned within perforation 33, with the annular space defined between tubular production port 22 and the wall of perforation 33 being the isolation port that would just dump mud filtrate into the wellbore, while tubular production port 22 would provide a path to product desired well fluids to the surface. Certainly, the material for pad assembly 20 does not have to be rubber; for example other non-limiting embodiments anticipate that it can be a metal or other composite material pad or coated metal or other composite material pad.

As shown in FIG. 2, isolation ports 25 are arranged equally spaced and concentrically around production port 22. However, it should be understood that any suitable arrangement of isolation ports 25 around a production port 22 may be utilized, and that would include any regular or irregular geometric grouping or pattern of isolation ports 25 around production port 22. Further, it should be understood that isolation ports 25 may be equally or unequally spaced from each other, and while all isolation ports 25 are shown as being spaced equally from production port 22, some embodiments will feature isolation ports of various distances form production port 22. Even further, it should be understood that there may be one or more concentric arrangements of isolation ports 25 around production port 22. Still further, it should be understood that isolation ports 25 may be placed in non-concentric arrangements around production port 22. Yet further, it should be understood that in some non-limiting embodiments, production member may be positioned within the middle of a perforation, with the isolation member then being the annular space defined between the production member (i.e., a pipe, tube, conduit or other such member) and the wall of the perforation.

The ratio of isolation ports (#IP) to production ports (#PP) will be at least 1, 2, 3, 4, 5, 6, 7, 8, 9, 10, 20, 30, 40, 50, 60, 70, 80, 90, 100, 250, 500, 1000, 10000, 100000 or any ratio in the range from/to or between any of two of the previous numbers. As non-limiting examples, the ratio of the number of isolation ports to production ports (#IP:#PP) will be at least 1, 10, 100, 1000, 10000, or 100000 or may be in the range from 1 to 100000, from 5 to 10000, from 10 to 1000, between 1 and 100000, between 7 and 10000, and the like as selected from the list of ratio values as shown above.

The cross-sectional shape of the isolation ports and the production port as shown in FIG. 1 is circular. Certainly, a circular shape is fairly easy to make as opposed to any other shape, but that is not to say such a circular shape is always utilized. It should be understood that the cross-sectional shape of the isolation ports and production ports may be any suitable regular or irregular geometric shape as desired to produce the mud filtrate and formation fluid.

As shown in FIG. 2, the longitudinal shape of the isolation ports and the production ports are all the same, namely the shape of a regular cylinder. It should be understood that various shapes, the various ports could also be tapered, curvilinear, and the like. The lining of the various ports may be smooth, rough, patterned, textured and the like as desired. The various ports may also comprise additives, or chemicals as desired to treat the product and/or mud filtrate.

Packers 51 are set above and below the apparatus to provide an "isolation" chamber 65 to contain the produced filtrate, with a similar "isolation" chamber 66 provided to contain the produced formation fluids. Certainly, these flow through these chambers 65 and 66 may be regulated, batch, or continuous, as may be desired. In some instances, fluid is gathers in these chambers and emptied from time to time, in other instances there may be a level control that controls flow out of these chambers, in even other instances the flow may be continuous through these chambers, all as desired for any particular well operation. Tubing 145 through the upper packer will produce the filtrate to the surface, and tubing 38 will produce desired formation fluids to the surface, via differential pressure and/or pumping. After the casing has been cemented, the perforating guns in the production ports are fired to begin production of formation fluid.

The various isolation ports and production ports may be provided on some sort of assembly, a non-limiting example of which is shown in FIG. 2. This assembly is then affixed to the casing at the desire position. The present invention also contemplates the use of casing in which various isolation ports and production ports are preformed, with this casing then positioned as desired. As another non-limiting option these ports could be incorporated into controllable unit or machine and positioned in place as desired.

In some non-limiting embodiments, isolation ports and production ports may be provided with fluid identification sensors, allowing comparison of fluid compositions in the isolation ports and the production ports. When flow is first established, compositions in the isolation ports and production ports will generally be the same, and that would include both being contaminated by mud filtrate. As flow continues the mud filtrate is preferentially drawn into the isolation ports. After some amount of operation, an equilibrium condition is reached in which desired formation fluid (free or relatively free of mud filtrate) is drawn into the production port, and the contaminating mud filtrate is drawn into the isolation ports. The fluid identification sensors are one way of determining when this equilibrium condition has been reached. At this point, the fluid flowing through the production ports is free or nearly free of contamination by mud filtrate. In some non-limiting embodiments of the present invention, it is possible that only one of the hydrocarbon or the mud filtrate may require a production tubing, with the cased wellbore itself being one of the tubings. In some non-limiting embodiments of the present invention, it is also possible that the mud filtrate may be re-injected downhole into a separate zone of lower pressure that has been depleted or does not contain hydrocarbons or to raise the pressure of another hydrocarbon or water producing zone for enhanced or improved oil recovery.

Various non-limiting embodiments of the present invention are generally carried out in a completed wellbore, and operate independently of any wireline or drill pipe. Various non-limiting embodiments of the present invention are generally not carried out during any drilling operations.

Various non-limiting embodiments of the present invention, will over time allow the isolation ports to remove the mud filtrate from around the borehole over the entire producing zone(s) over time, reducing the invaded mud filtrate zone throughout the production life of the well, and with increasing time removing more and more mud filtrate from the zone(s), to the point of removing most of the mud filtrate, substantially all of the mud filtrate, and ultimately all of the mud filtrate (for that/those zone/s).

EXAMPLES

The following example is merely provided to illustrate one non-limiting embodiment of the present invention.

As a prophetic example—an Austin Chalk well just above a certain Shale play somewhere in Texas is producing over 1000 barrels a day. At $100 per barrel, that amounts to over $100,000 per day or over $36,500,000 per year, that is, if the production were pure oil. Unfortunately, the production averages at least 10% mud filtrate, and this will continue for years. With the production averaging 10% mud filtrate, the annual income is reduced by $3,650,000 per year. Of course this loss of income is further exacerbated by the extra cost of transporting the oil/filtrate and the cost of separating the mud filtrate from the oil. The methods, apparatus and products of the present invention provide for the separation of oil and filtrate down hole and each is produced via separate tubing. Now the production is pure (or relatively pure) hydrocarbon, the extra oil transportation cost is reduced, and there is no separation cost (transporting the filtrate for re-use will not change).

All of the patents, publications, articles, books, journals, brochures, cited therein, are herein incorporated by reference.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

The invention claimed is:

1. A method for producing a desired formation fluid from a producing zone in a formation below a terranean surface, the formation surrounding a cased wellbore having a drilling fluid, the method comprising:

(a) placing a production member into the cased wellbore in fluid communication with the producing zone to allow the desired formation fluid to flow into the production member, the production member having a first controlled pressure;

(b) placing an isolation member into the cased wellbore, said isolation member defining an isolation zone adjacent the producing zone said isolation member being maintained at a second controlled pressure;

(c) creating a flow path defined from the production member to the surface for allowing the desired formation fluid to flow to the surface;

(d) controlling the pressures of the production member and isolation member such that the isolation member pressure is the same as or lower than the production member pressure such that flow of the drilling fluid into the producing zone is impeded;

(e) flowing formation fluid from the production zone to the surface through the flow path;

(f) expanding a pair of isolation packers on the isolation member to engage the casing;

(g) expanding a pair of production packers on the production member to engage the casing and defining the production zone therebetween, the production packers being disposed between the isolation packers and defining the isolation zone between each of the production packers and the adjacent isolation packer;

(h) activating an inner tube on the production member to penetrate the formation to define the production zone, and (i) activating an outer tube on the isolation member to penetrate the formation, to define the isolation zone as a region between the inner tube and the outer tube.

2. A method for producing a desired formation fluid from a producing zone in a formation below a terranean surface, the formation surrounding a cased wellbore having a drilling fluid, the method comprising:

(a) placing a production member into the cased wellbore in fluid communication with the producing zone to allow the desired formation fluid to flow into the production member, the production member having a first controlled pressure;

(b) placing an isolation member into the cased wellbore, said isolation member defining an isolation zone adjacent the producing zone said isolation member being maintained at a second controlled pressure;

(c) creating a flow path defined from the production member to the surface for allowing the desired formation fluid to flow to the surface;

(d) controlling the pressures of the production member and isolation member such that the isolation member pressure is the same as or lower than the production member pressure such that flow of the drilling fluid into the producing zone is impeded;

(e) flowing formation fluid from the production zone to the surface through the flow path;

(f) retrieving fluid from the isolation zone;

(g) comparing the production zone fluid with the isolation zone fluid (h) holding off on flowing formation fluid to the surface until determining when the production zone fluid is substantially free of contaminating fluid; and (i) flowing formation fluid to the surface.

3. The method of claim 2, further comprising (j) discharging the isolation zone fluid into the formation.

4. The method of claim 2, wherein the flowing of step (i) is achieved by pumping the formation fluid to the surface.

5. A method for producing a desired formation fluid from a producing zone in a formation below a terranean surface, the formation surrounding a cased wellbore having a drilling fluid, the method comprising:

(a) placing a production member into the cased wellbore in fluid communication with the producing zone to allow the desired formation fluid to flow into the production member, the production member having a first controlled pressure;

(b) placing an isolation member into the cased wellbore, said isolation member defining an isolation zone adjacent the producing zone said isolation member being maintained at a second controlled pressure;

(c) creating a flow path defined from the production member to the surface for allowing the desired formation fluid to flow to the surface;

(d) controlling the pressures of the production member and isolation member such that the isolation member pressure is the same as or lower than the production member pressure such that flow of the drilling fluid into the producing zone is impeded;

(e) flowing formation fluid from the production zone to the surface through the flow path;

(f) connecting an isolation flow line to the isolation member and expanding a pair of isolation packers on the isolation member to engage the casing;

(g) connecting a production flow line to the production member and expanding a pair of production packers on the production member to engage the casing and defining the production zone therebetween, the production packers being disposed between the isolation packers and defining the isolation zone between each of the production packers and the adjacent isolation packer; and (h) lowering the pressure in the isolation flow line to below the pressure of the production flow line;

(i) activating an inner tube on the production member to penetrate the formation to define the production zone, and (j) activating an outer tube on the isolation member to penetrate the formation, to define the isolation zone as a region between the inner tube and the outer tube.

6. The method of claim 5 further comprising (k) holding off on flowing formation fluid to the surface until determining when the fluid in the production flow line is substantially free of drilling fluids.

* * * * *